United States Patent [19]

Walsh

[11] 4,254,363

[45] Mar. 3, 1981

[54] ELECTRODELESS COUPLED DISCHARGE LAMP HAVING REDUCED SPURIOUS ELECTROMAGNETIC RADIATION

[75] Inventor: Peter Walsh, Stirling, N.J.

[73] Assignee: Duro-Test Corporation, North Bergen, N.J.

[21] Appl. No.: 972,402

[22] Filed: Dec. 22, 1978

[51] Int. Cl.[3] ..... H05B 41/16; H05B 41/24

[52] U.S. Cl. ..... 315/248; 315/57; 315/70; 315/85; 313/242

[58] Field of Search ..... 315/39, 57, 248, 344, 315/85, 70; 313/242

[56] References Cited

U.S. PATENT DOCUMENTS

| | | | |
|---|---|---|---|
| 2,790,936 | 4/1957 | Bell | 315/248 X |
| 2,939,049 | 5/1960 | Blackman | 315/248 X |
| 3,521,120 | 7/1970 | Anderson | 315/57 |
| 3,987,334 | 10/1976 | Anderson | 315/248 |
| 4,171,503 | 10/1979 | Kwon | 315/248 |
| 4,187,445 | 2/1980 | Houston | 315/248 |
| 4,187,447 | 2/1980 | Stout et al. | 315/85 |

FOREIGN PATENT DOCUMENTS

| | | | |
|---|---|---|---|
| 369649 | 4/1973 | U.S.S.R. | 315/248 |

*Primary Examiner*—Saxfield Chatmon, Jr.
*Attorney, Agent, or Firm*—Darby & Darby

[57] ABSTRACT

An electrodeless discharge lamp having a sealed elongated toroidal envelope containing an ionizable medium with means for inducing ionization of the medium including a radio frequency energy supply coil formed by coating a transparent conductive material on the envelope. The coil is mounted to reduce the stray radio frequency field and the torroidal envelope is formed to allow for convection cooling of the lamp.

31 Claims, 5 Drawing Figures

ELECTRODELESS COUPLED DISCHARGE LAMP HAVING REDUCED SPURIOUS ELECTROMAGNETIC RADIATION

BACKGROUND OF THE INVENTION

This invention relates to electrodeless discharge lamps and more particularly to an improved design for such a lamp which yields higher efficiency, lower thermal loading and reduced radio interference as compared to lamps found in the prior art.

An electrodeless discharge lamp is described in U.S. Pat. No. 4,010,400 issued to Donald D. Hollister on Mar. 1, 1977. The lamp of that patent includes a sealed envelope, an ionizable medium within the envelope and a coil of wire wrapped around a non-magnetic core and positioned adjacent the envelope in close physical proximity to the ionizable medium to supply radio frequency (RF) energy to the medium. The ionizable medium emits radiant energy when subjected to the radio frequency field.

The lamp disclosed in the Hollister patent has the general overall shape of a conventional incandescent lamp, the coil being positioned in an open cylindrical cavity which extends through part of the distance of the envelope. This design has several resultant disadvantages. First, it does not have an optimum shape for discharge efficiency nor for coupling of the radio frequency energy to the ionizable medium. Additionally, there is a relatively high amount of thermal loading, i.e. a large amount of heat is generated inside of the lamp envelope. Although the frequency of the RF energy is chosen so that the base frequency and several higher harmonics do not interfere with FCC allotted broadcast frequencies, the energy from the high frequency coil produces a substantial amount of radio frequency interference within the immediate environment of the home or office. This can cause objectionable local radio interference with radio, T.V., microwave ovens, and the human body.

U.S. Pat. No. 3,521,120 issued to J. M. Anderson on July 21, 1970 shows an electrodeless fluorescent lamp having a hermetically sealed toroidal envelope containing an ionizable medium with the envelope surrounding a radio frequency coil and the ionizable medium is activated by the coil. This patent does not teach a design which maintains the RF field within the discharge volume, nor does it teach an arrangement for cooling the toroidal envelope. It therefore has two of the disadvantages of the Hollister lamp, i.e. the problems of radio frequency interference and high thermal loading.

It is an object of the present invention to provide an electrodeless discharge lamp having a geometry optimized for discharge efficiency and radio frequency coupling.

A further object is to provide an electrodeless discharge lamp having increased cooling efficiency as compared to lamps of the prior art.

Another object is to provide an electrodeless discharge lamp which substantially reduces radio frequency interference.

An additional object is to provide an electrodeless discharge lamp in which the heat distribution is more uniform than that found in lamps of the prior art.

Still a further object is to provide an electrodeless discharge lamp which is cooled by convection.

In accordance with the invention, an electrodeless discharge lamp is provided which utilizes an envelope having a toroidal shape. A toroid is defined as any planar shape which is rotated about an axis in the same plane, the axis not intersecting the planar shape. The envelope is hollow and is filled with an ionizable medium which is capable of emitting radiant energy when subjected to and ionized by the energy of a radio frequency field. In the preferred embodiment, transparent windings are coated on the interior, top and exterior surfaces of the envelope. The windings on the top and exterior surfaces confine the radio frequency field almost principally to within the toroid, thereby substantially eliminating radio interference while producing a more efficient coupling of radio frequency energy to the discharge. The free space near the bottom interior of the envelope is used to mount and cool the electronics needed to drive the radio frequency windings and provides convection to the interior of the toroid.

The foregoing brief description as well as further objects, features and advantages of the present invention are best appreciated by reading the following detailed description of several preferred embodiments in accordance with the invention while referring to the accompanying drawings.

DETAILED DESCRIPTION OF THE DRAWINGS

DETAILED DESCRIPTION OF THE PREFERRED EMBODIMENT

Figure 1:
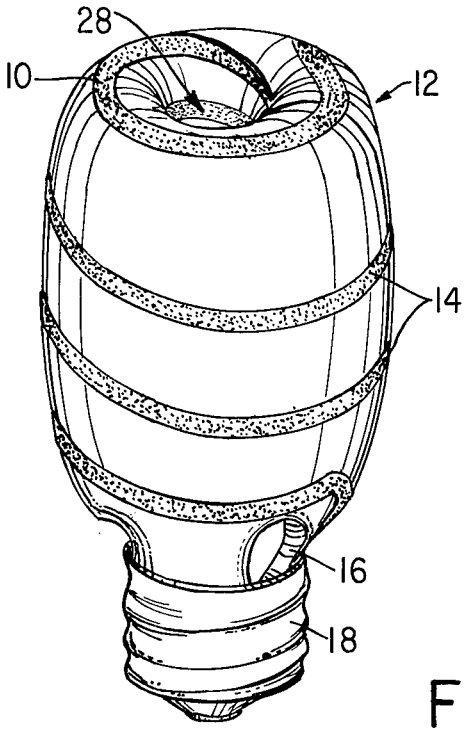
FIG. 1 is a perspective view of a lamp in accordance with the present invention.

Referring to the drawings, the lamps of the present invention are designed to fit into a socket of the type used by a conventional incandescent bulb. They have a distinctive envelope which is shaped like a hollow toroid in the form of an elipse rotated about an axis of revolution external to the elipse. This envelope is fitted into a base, and is filled with an ionizable medium. In the preferred embodiment transparent windings are coated on the interior, top and exterior surfaces of the toroidal envelope. An air gap provided in the envelope near the base of the lamp allows for convection cooling.

A perspective view showing the toroidal shape of envelope 12 is shown in FIG. 1. The outside dimensions are similar to those of a conventional incandescent bulb. The diameter, i.e. the distance between the outermost walls of the toroid, is chosen to optimize the electron temperature. Its height, i.e. the distance from top to bottom of the toroid, spreads out the current density to provide more uniform loading and allow for the maintenance of a lower current density throughout the envelope. This lower current density is favorable to high efficiency.

Figure 2:
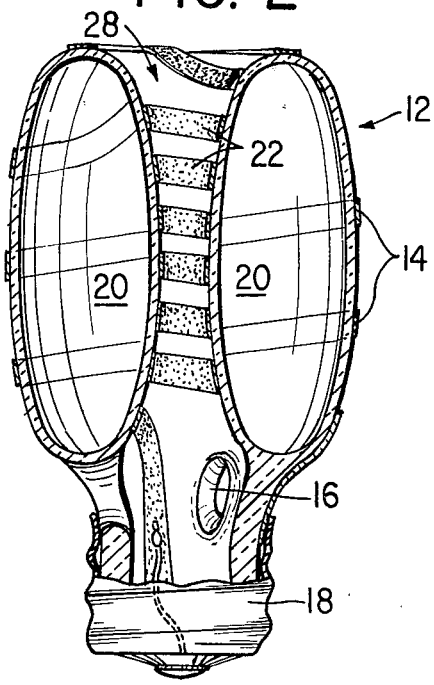
FIG. 2 is a cross-sectional elevation of the lamp of FIG. 1.

A cross-section of the toroid taken through a plane containing the axis of revolution, as shown in FIG. 2, shows that the discharge region 20 of the envelope is elliptical in shape in order to prevent discharge constriction. In one preferred embodiment of the invention, the maximum width of the ellipse, i.e. the distance between the interior and exterior walls of the envelope for one ellipse, is approximately 1½ inches. An overall outside diameter of the envelope or about 3½ inches will provide adequate space for electronics to be positioned near the bottom of the interior opening of the toroid and for convection currents. A height of about 4 inches is desirable. These dimensions, are merely illustrative suggestions and, of course, a toroidal envelope of any reasonable size would be suitable.

The envelope is filled with any suitable ionizable medium. For example, the envelope may be charged with mercury vapor and an inert gas, such as argon. A layer of a fluorescent light emitting phosphor such as any of the standard halophosphates or fluorophosphates, is also preferably on the surface of the discharge region 20. The mercury vapor and inert gas, when ionized, will produce ultraviolet radiation. The fluorescent light emitting phosphor layer effectively converts the ultraviolet radiation to visible radiation, although for some applications this may be not desirable and the layer may be omitted. The type of radiation emitted, e.g. ultraviolet, visible, etc., is dependent on the particular ionizable medium used, and one skilled in the art will be capable of making an appropriate choice.

In a preferred embodiment windings are coated on the surface of the toroid using a transparent conductive coating. Tin oxide may be used for this purpose. These windings consist of exterior windings 14, a top winding 10 and interior windings 22.

The windings 14 and 22 on the exterior and interior of the envelope, respectively, are helically shaped and are coated in opposed directions. The windings serve two functions. They couple the electric field to the medium and initiate ionization. Simultaneously, they couple a radio frequency magnetic induction field to the medium for maintaining the ionization. The peak magnitude and frequency of the magnetic induction field is selected to optimize the efficiency of conversion of radio frequency energy to emitted radiant energy.

The windings 14 on the exterior of the lamp force the radio frequency field almost wholly within the toroidal envelope. The top winding 10 eliminates any stray end fields. It is these windings which cause the radio frequency interference to be substantially eliminated and efficient coupling of radio frequency power to the ionizable medium to be effected.

The ratio of the number, $N_2$, of the turns of the exterior windings 14 to the number, $N_1$, of turns of the interior windings 22 can be determined by setting the flux of the magnetic field flowing up in the interior opening 28 of the toroidal envelope to equal the flux flowing down within the discharge region 20. If the windings have the same axial length this requires:

$$\phi_1=\phi_2$$

$$(B_1-B_2)A_1=B_2(A_2-A_1)$$

$$B_1-N_1i;\ B_2-N_2i$$

$$(N_1-N_2)A_1i=N_2(A_2-A_1)i$$

$$(N_1-N_2)A_1=N_2(A_2-A_1)$$

$$N_1A_1-N_2A_1=N_2A_2-N_2A_1$$

$$N_1A_1=N_2A_2$$

$$A_1/A_2=N_2/N_1$$

where:

$A_2$ is the total cross-sectional area normal to the axis of symmetry enclosed between the exterior windings; $A_1$ is the total cross-sectional area normal to the axis of symmetry enclosed between the interior windings; $B_2$ induction field created by the exterior winding. $B_1$ is the magnetic induction field created by the interior windings.

Additionally, $$\begin{aligned} M_2 &= N_2(A_2-A_1)i \\ &= N_2A_2i-N_2A_1i \\ M_1 &= (N_1-N_2)A_1i \\ &= N_1A_1i-N_2A_1i \end{aligned}$$

since $$N_1A_1=N_2A_2,$$

$$M_1=N_2A_2i-N_2A_1i$$

$$M_1=M_2$$

The M's are the dipole moments of the windings. $M_2$ relates to exterior windings; $M_1$ to the interior ones. With $M_2=M_1$, the net magnetic dipole moment, $M_2-M_1$, is zero. In that case, there is no radiation field associated with the complete set of windings.

The envelope is securely positioned in base 18, which is preferably an adapter designed to fit into a socket for a conventional incandescent bulb.

The electronics 30 for activating the solenoidal windings are connected to the base 18. They are preferably positioned within a region bounded by the interior opening of the toroid and the base. The electronics are of the solid state variety, i.e. transistors(s) and/or IC's. If AC is supplied to the lamp socket, the electronics include a suitable rectifier. The electronics can also be located separately from the lamp in which case the RF energy is supplied to the socket and the electronics are made to contact the socket.

An air gap 16, in the envelope near the base, allows for convection cooling of the interior surface, the exterior surface and the electronics of the lamp. The air gap is simply an aperture through the envelope which permits air to flow from the external environment of the lamp into the interior of the toroid, permitting the air which is heated by the interior electronics to rise through the interior of the toroid into the external environment of the lamp.

In use, the base of the lamp of the present invention is screwed into a standard socket of they type used for a conventional incandescent bulb. When the switch necessary to close the circuit is turned "on", the windings act to couple RF energy to the ionizable medium within the toroidal envelope. The ionizable medium is ionized and emits radiation. Simultaneously, a radio frequency magnetic induction field is emitted by the same windings and is coupled to the medium for maintaining the ionization. If non-visible radiation, e.g. ultraviolet radiation, is emitted by the ionizable medium it is necessary to coat a suitable phosphor of other material on the surface of discharge region 20 inside the toroid so that visible radiation is produced. If visible radiation is produced directly by the ionizable medium an additional coating will not be necessary. The type of radiation produced is dependent on the particular ionizable medium which is used, as is described above, and one skilled in the art will be well qualified to make an appropriate selection. For some applications ultraviolet radiation, without conversion to visible radiation may be desirable.

The interior electronics and interior surface of the toroid are cooled by convection currents. Air, which is heated by the electronics in the bottom interior of the toroid, flows upward in the interior of the toroid in accordance with the well-known law of nature that hot air rises. As the warm air rises, cooler air from the external environment of the toroid flows through the air gap near the base of the lamp. This continual replacement of warm air by cooler air acts in two ways. First, the ambient temperature of the air in the interior of the lamp is lower than would otherwise be the case. Additionally, the convection currents both in the interior of the toroid and in the external environment of the lamp act in the manner of gentle breeze to cool the windings and surface of the lamp.

Figure 3:
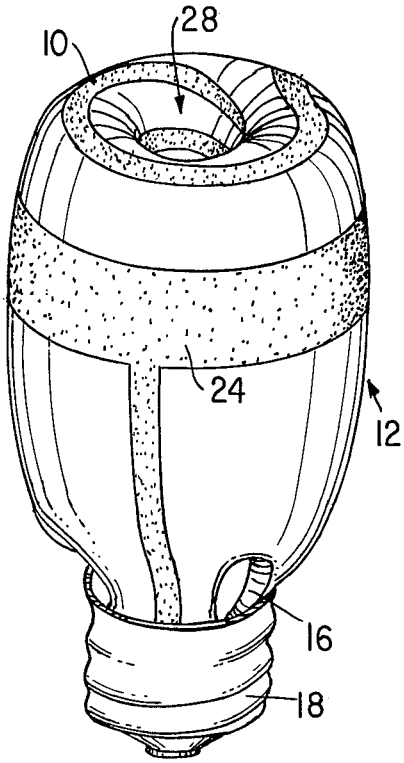
FIG. 3 is a perspective view of a further embodiment of a lamp in accordance with the present invention.
Figure 4:
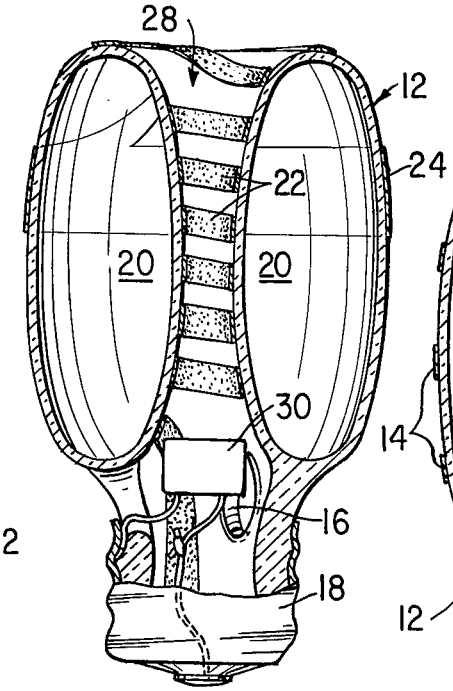
FIG. 4 is a cross-sectional elevation of the lamp of FIG. 3.
Figure 5:
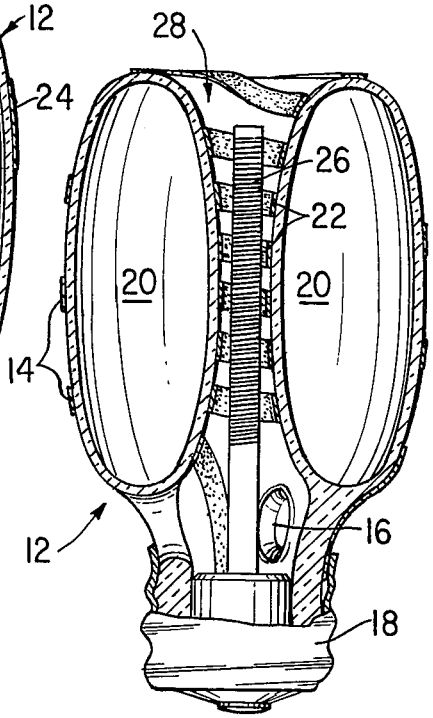
FIG. 5 is a cross-sectional elevation view of an alternate embodiment of the lamp of either FIG. 1 or FIG. 3.

In a further embodiment shown in FIG. 3 a shielding plane 24 is coated on the exterior surface of the envelope in place of the exterior windings 14. The shielding plane preferably comprises a transparent coating of tin oxide. Any form or shape of plane which would confine the radio frequency field within the discharge region is acceptable, one form being shown in the drawings. The interior may be provided with either a coated set of interior windings 22 as shown in FIG. 4, or a conventional solenoid 26 as shown in FIG. 5. In either case, the currents produced in the shielding plane by the radio frequency field act similarly to the currents in the exterior winding to confine the magnetic and electric fields.

Although the invention has been described in terms of specific embodiments for illustrative purposes, it will be appreciated by one skilled in the art that numerous additions, substitutions, and modifications are possible without departing from the scope and spirit of the invention as defined in the accompanying claims.

What is claimed is:

1. An electrodeless discharge lamp comprising a sealed envelope having a substantially toroidal shape with an internal and an external surface, an ionizable medium within said envelope for emitting radiant energy when subjected to an alternating current field at or about radio frequency, means for supplying alternating current, and first means adjacent the interior surface and second means adjacent the external surface of the envelope, each coupled to said energy supplying means and producing an alternating current field which reacts with the medium in the envelope, and said first and second means producing alternating current fields which are at least partially opposing for confining the alternating current field to the area adjacent the envelope.

2. An electrodeless discharge lamp as in claim 1 wherein said first means comprises a number of turns of a first winding coated on said surface.

3. An electrodeless discharge lamp as in claim 1 wherein said second means comprises at least one turn of a second winding coated on said other surface which is wound to produce an alternating current field in a direction to oppose the alternating current field produced by the first winding on said one surface.

4. An electrodeless discharge lamp as in claim 2 wherein said one surface is the inner surface of said envelope.

5. An electrodeless discharge lamp as in claim 4 wherein said second winding comprises at least one turn of a winding on the outer surface of said envelope.

6. An electrodeless discharge lamp as in claim 5 wherein the turns of each of the respective first and second windings is in the form of a helix and the windings are wound in respective opposite directions.

7. An electrodeless discharge lamp as in claim 3 wherein said means for supplying alternating energy comprises oscillator means having an output coupled to the winding of said one surface.

8. An electrodeless discharge lamp as in claim 7 wherein said oscillator means is coupled to the windings on both said surfaces.

9. An electrodeless discharge lamp as in claim 1 wherein said means for supplying said alternating current comprises solenoid means located in the hollow interior portion of said torroidal envelope.

10. An electrodeless discharge lamp as in claim 3 when the winding on at least the outer surface of the envelope is substantially transparent.

11. An electrodeless discharge lamp as in claim 3 wherein the magnetic dipole moment of the winding on said one surface is substantially equal to the magnetic dipole moment of the winding on the outer surface.

12. An electrodeless lamp as in claim 8 wherein said envelope further comprises a base having a pair of contacts, the output of said oscillator means being connected across said pair of contacts, and an end of each said winding connected to a respective one of said contacts.

13. An electrodeless discharge lamp as in claim 2 wherein said winding on said one surface extends onto the top surface of said envelope.

14. A lamp as defined in claim 1, wherein said envelope is apertured to permit air to flow from the external environment of the lamp into the interior of the toroid.

15. A lamp as defined in claim 1, wherein a cross-section of the toroidal envelope has the shape of an ellipse.

16. A lamp as defined in claim 15, wherein the ellipse has a width of about $1\frac{1}{2}$ inches and the envelope has an overall outside diameter of about $3\frac{1}{2}$ inches and an overall height of about 4 inches.

17. An electrodeless discharge lamp comprising:

a sealed envelope having a toroidal shape;

an ionizable medium inside said envelope which is capable of emitting radiant energy when subject to an alternating current field at or about radio frequency field;

means for supplying alternating current, at least one winding coated on one of the interior and exterior surfaces of said envelope coupled to said current supplying means for coupling the alternating current field to said medium; and a shielding plane coated on the said exterior surface of said envelope for confining the alternating current field to said envelope.

18. A lamp as in claim 17 wherein the winding for coupling the alternating current field is on the interior surface of the envelope and the shielding plane is on the outer surface.

19. A lamp as in claim 17, wherein said windings and said shielding plane are transparent.

20. A lamp as in claim 19, wherein said windings and said shielding plane comprise tin oxide.

21. A lamp as in claim 17 wherein said lamp further comprises a base connected to said envelope and an electronic circuit for activating said windings, said electronic circuit being connected to said base and surrounded by the interior surface of the envelope.

22. A lamp as in claim 17, wherein said envelope is aperatured to permit air to flow from the external environment of the lamp into the interior of the toroid.

23. A lamp as in claim 17, wherein a cross section of the toroidal envelope has the shape of an ellipse.

24. A lamp as in claim 17, wherein each ellipse has a width of about 1½ inches and the envelope has an overall outside diameter of 3½ inches and an overall height of about 4 inches.

25. An electrodeless discharge lamp comprising:

a sealed envelope having a toroidal shape;

an ionizable medium inside said envelope which is capable of emitting radiant energy when subject to an alternating current field at or about radio frequency;

a solenoid positioned in the interior opening of the envelope for coupling the alternating current field to said medium; and a shielding plane coated on an exterior surface of said envelope for confining the alternating current field to said envelope.

26. A lamp as defined in claim 25, wherein said shielding plane is transparent.

27. A lamp as defined in claim 25, wherein said shielding plane comprises tin oxide.

28. A lamp as defined in claim 27, wherein said lamp further comprises a base connected to said envelope and an electronic circuit for activating said shielding plane said electronics being connected to said base and surrounded by the interior surface of the envelope and said base.

29. A lamp as defined in claim 25, wherein said envelope is aperatured to permit air to flow from the external environment of the lamp into the interior of the toroid.

30. An electrodeless discharge lamp comprising:

a sealed envelope having a substantially toroidal shape with a hollow interior and an open end;

an ionizable medium within said envelope for emitting radiant energy when subjected to at alternating current field at or about radio frequency, means for producing, alternating current, means coupled to said alternating current producing means for coupling an alternating current field to said medium, said envelope formed with at least one aperture from the outer surface thereof through the envelope to the hollow interior of the toroid to provide an air flow path from the exterior of the envelope through the hollow interior portion and its open end.

31. An electrodeless discharge lamp as in claim 30 wherein the toroid extends from a solid base portion of said envelope, said at least one aperture formed in said solid base portion.

* * * * *